US007066826B2

(12) United States Patent
Tsoi

(10) Patent No.: US 7,066,826 B2
(45) Date of Patent: Jun. 27, 2006

(54) LASER HEAD ADJUSTMENT DEVICE FOR LASER PUTTER

(76) Inventor: Pak Wing Tsoi, Flat 402, 28 Nong Lin Dong Road, Jaingmen City, Guangdong Province (CN)

( * ) Notice: Subject to any disclaimer, the term of this patent is extended or adjusted under 35 U.S.C. 154(b) by 0 days.

(21) Appl. No.: 11/109,867

(22) Filed: Apr. 20, 2005

(65) Prior Publication Data

US 2005/0245322 A1 Nov. 3, 2005

(30) Foreign Application Priority Data

Apr. 20, 2004 (CH) ..... 2004 2 0045078

(51) Int. Cl.
*A63B 69/36* (2006.01)

(52) U.S. Cl. ..... 473/220; 473/219; 473/251

(58) Field of Classification Search ..... 473/219–226, 473/251, 252
See application file for complete search history.

(56) References Cited

U.S. PATENT DOCUMENTS 5,374,063 A * 12/1994 Ogden ..... 473/220
5,482,283 A * 1/1996 Wall ..... 473/220
5,593,354 A * 1/1997 Falossi et al. ..... 473/220
5,707,296 A * 1/1998 Hodgson et al. ..... 473/220
5,810,674 A * 9/1998 Falossi et al. ..... 473/220
5,980,393 A * 11/1999 Molinaroli et al. ..... 473/220

* cited by examiner

*Primary Examiner*—Nini F. Legesse
(74) *Attorney, Agent, or Firm*—Leydig, Voit & Mayer, Ltd.

(57) ABSTRACT

A head for a practice putter includes a front face with a ball-strike area, a pair of laser beam emitters located within the head and each emitting a laser beam at a respective side of the ball-strike area. The laser beams converge with one another to a point several yards directly forward of the ball-strike area.

4 Claims, 4 Drawing Sheets

-101-

LASER HEAD ADJUSTMENT DEVICE FOR LASER PUTTER

BACKGROUND OF THE INVENTION

More particularly, although not exclusively, the invention relates to a practise putter having laser beam emitters to assist a golfer in perfecting his or her putting skills.

It is known to provide practise putters with a pair of laser beam emitters projecting parallel beams straight forward of the front face of the putter head at either side of the ball-strike area of the putter head's front face. In use, the laser beams are aligned with the left or right edges of the target hole on the putting green or practise area to assist the golfer in achieving a well-aligned putting swing. Such practise putters suffer the disadvantage of providing no indication to the user of the distance between the putter head and the target point.

OBJECTS OF THE INVENTION

It is an object of the present invention to overcome or substantially ameliorate the above disadvantage and/or more generally to provide an improved practise putter.

SUMMARY OF THE INVENTION

According to the invention, there is provided herein a head for a practise putter, comprising:

a front face with a ball-strike area; and a pair of laser beam emitters located within the head and each emitting a laser beam at a respective side of the ball-strike area, wherein the laser beams converge with one another to a point several yards directly forward of the ball-strike area.

Preferably, each laser beam emitter comprises beam emission angle adjustment means for adjusting the angle at which the laser beam is emitted therefrom.

It is preferred that each laser beam emitter comprises:

a body having a beam-emission opening and an elliptical recess behind the opening;

an elliptical enclosure received within the recess and having a laser light source therein; and a locking mechanism engaged upon the body to secure the elliptical enclosure firmly against the elliptical recess in selected angular alignment.

Preferably, the body includes an internal thread and the locking mechanism comprises a locator having an external thread engaging the internal thread, and a collar which bears against the elliptical enclosure upon the tightening of the collar within the body upon rotation.

More preferably, each laser beam emitter further comprises a sleeve extending rearward of the elliptical enclosure within the body and providing gripping means, by which the elliptical enclosure can be angularly repositioned against frictional engagement between the elliptical enclosure, the collar and the elliptical recess.

Further more preferably, each laser beam emitter further comprises a nut threaded upon the sleeve.

BRIEF DESCRIPTION OF DRAWINGS

The invention will now be more particularly described, by way of example only, with reference to the accompanying drawings, in which.

DESCRIPTION OF THE PREFERRED EMBODIMENT

Figure 1:
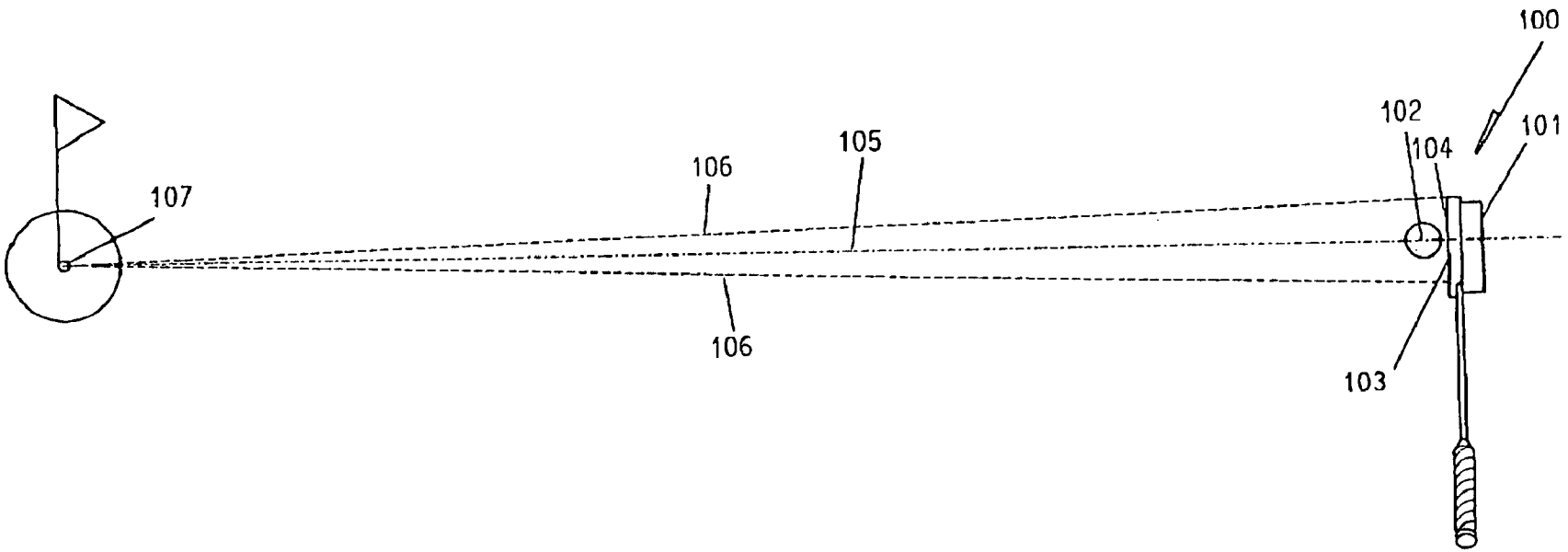
FIG. 1 is top plan view of an embodiment of a golf putter emitting a pair of convergent laser beams toward a hole.

Referring initially to FIG. 1 of the drawings, there is shown a golf putter 100 having a head 101. A golf ball 102 is positioned in front of a ball strike area 103 of the front face 104 of the putter head 101. A straight-ahead ball trajectory axis 105 is depicted. At either side of axis 105, there is shown a pair of convergent laser beams 106 which converge towards a point 107 several yards forward of the putter 100.

Figure 2:
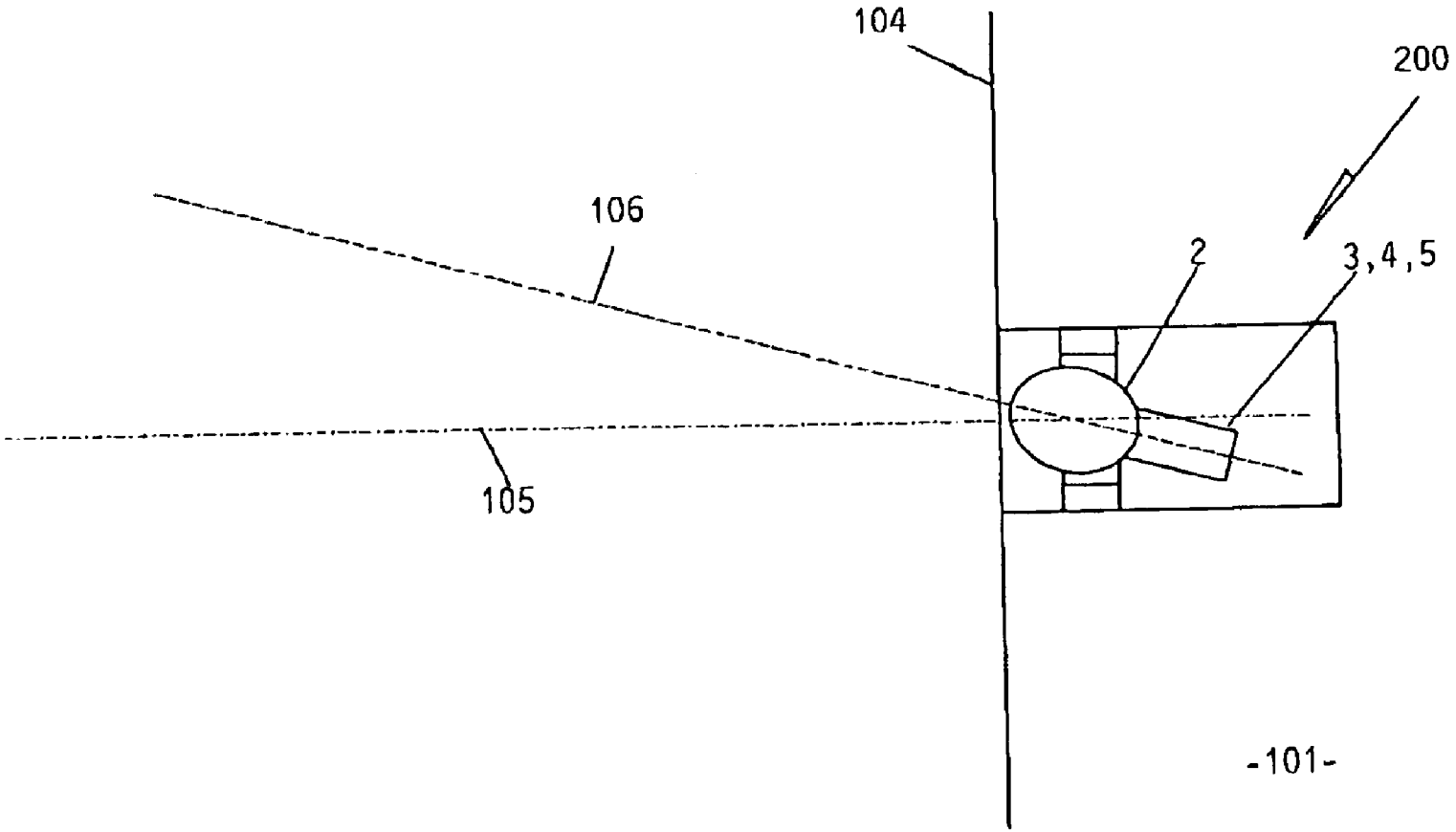
FIG. 2 is a top plan view of a laser beam emitter within a head of the golf putter of FIG. 1.
Figure 3:
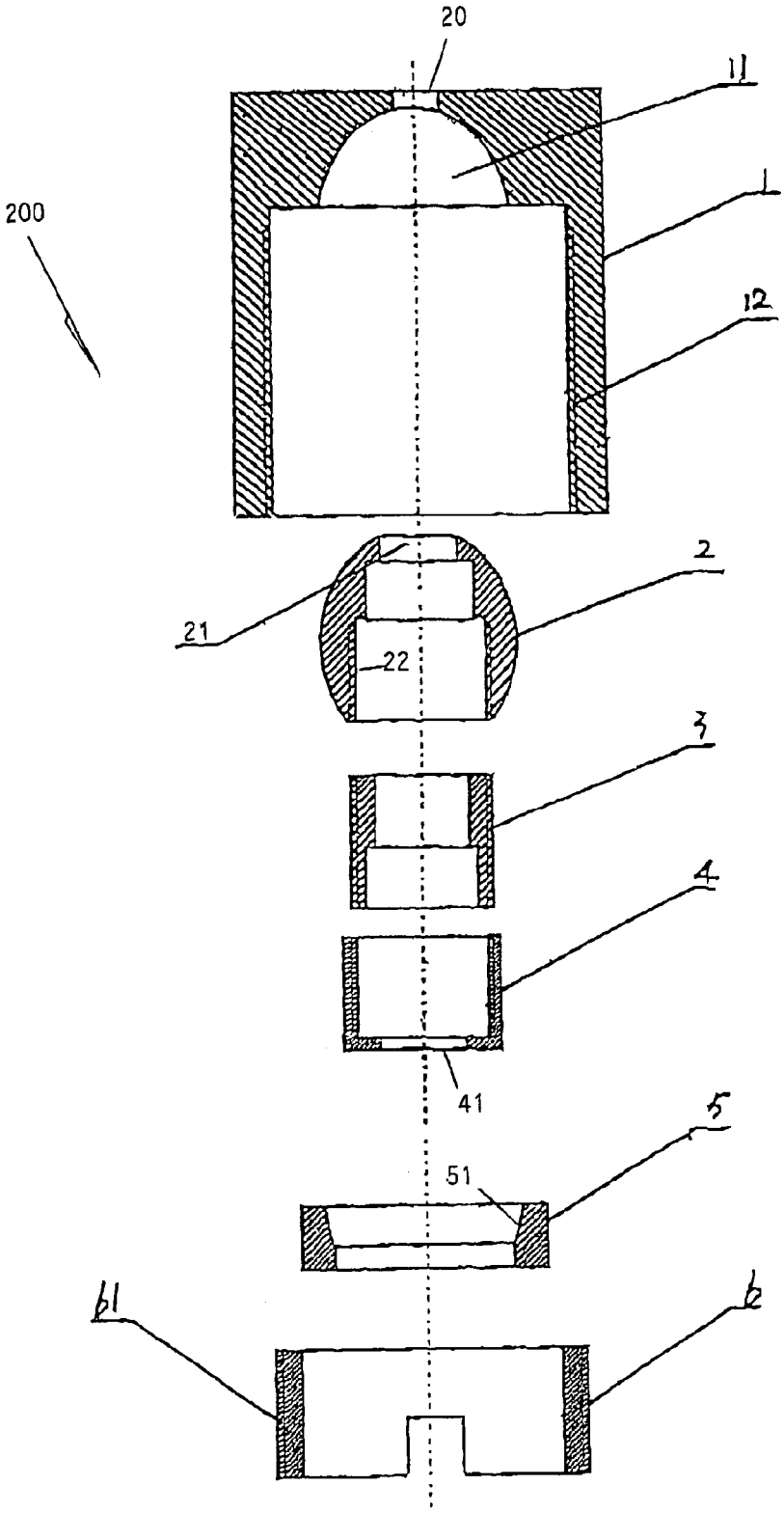
FIG. 3 is a parts-exploded cross-sectional view of a laser beam emitter of FIG. 2.
Figure 4:
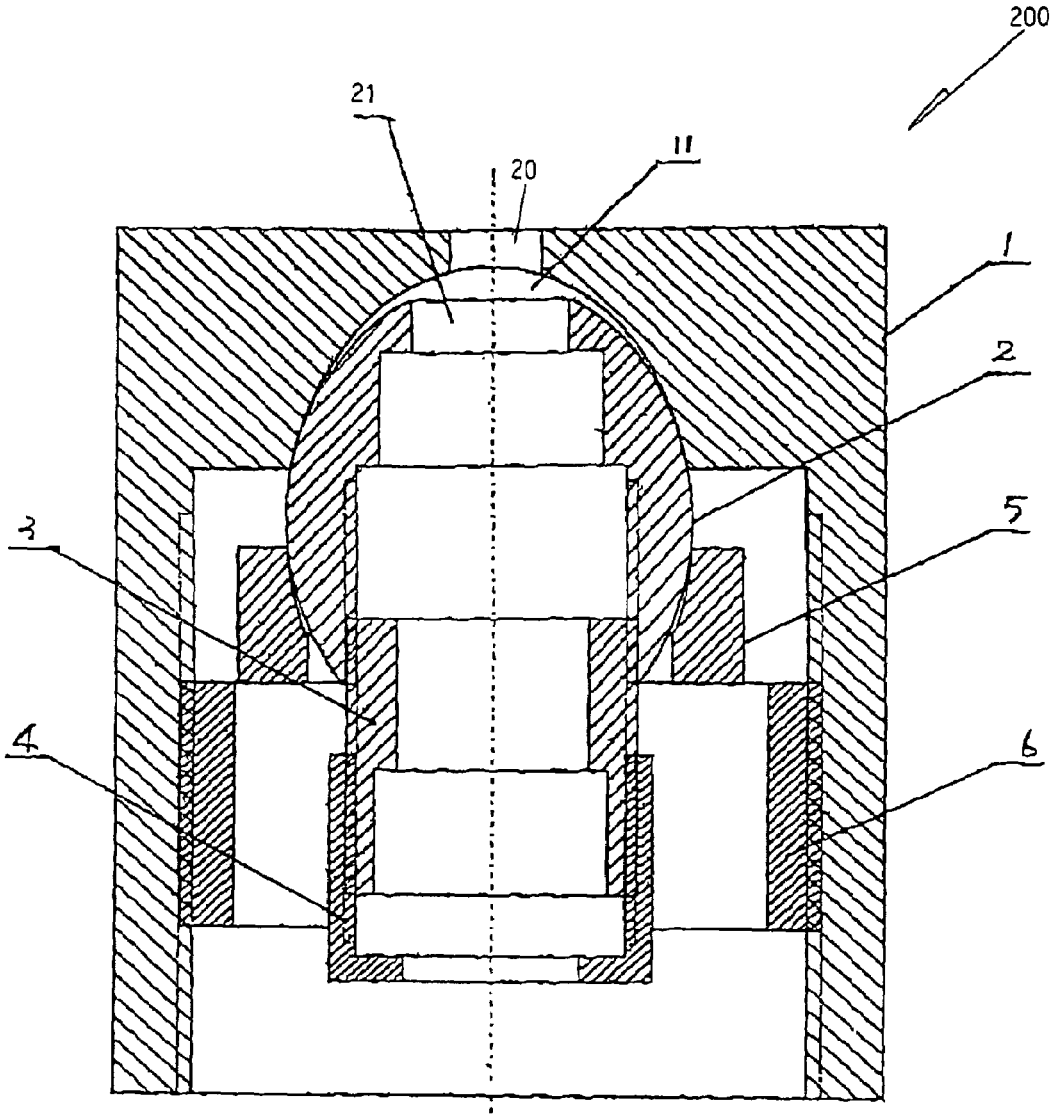
FIG. 4 is a cross-sectional view of the assembled laser beam emitter of FIG. 3.

FIG. 2 depicts one of two laser beam emitters 200 located at either side of the ball strike area 103 within the putter head 101. The structure of each laser beam emitter 200 is depicted schematically in FIGS. 3 and 4.

Each laser beam emitter 200 comprises parts which would typically be fabricated from brass or other metal more durable material including a body 1 having an opening 20 through which a laser beam 106 is emitted. Immediately behind the opening 20 is an elliptical recess 11. The body 1 has internal thread 12 behind the elliptical recess 11.

An elliptical enclosure 2 having a laser light source 21 (lens not shown) is received within the elliptical recess 11. A collar 5 having a frusto-elliptical bearing surface 51 bears against the elliptical enclosure 2. To this end, there is provided a locator 6 having external thread 61 engaging with the internal thread 12 of the body 1. The locator 6 is threadably engaged upon turning so that the collar 5 bears reasonably tightly against the elliptical enclosure 2 so that the enclosure 2 is firmly secured by friction against the elliptical recess 11 and collar 5. The degree of tightness is not to be so great as to deform the elliptical enclosure 2.

The elliptical enclosure 2 has internal thread 22 with which an externally threaded sleeve 3 engages. An externally threaded nut 4 fits over the sleeve 3 to enclose a circuit board (not shown) within the sleeve 3 to control the laser beam emitter 200 and provide a gripping means by which the elliptical enclosure 2 can be aligned and angularly calibrated. The nut 4 has an opening 41 through which wires can extend from the circuit board to a power source such as a battery located somewhere in the putter 100. A switch would also be provided to turn the laser beam emitters 200 on or off as desired.

Each laser beam emitter 200 is to be calibrated so that the beams 106 converge approximately four yards ahead of the front face 104 at a point along the trajectory axis 105. A tool can be used to engage the nut 4 for this purpose.

It should be appreciated that modifications and alterations obvious to those skilled in the art are not to be considered as beyond the scope of the present invention. For example, each laser beam emitter 200 might comprise means to emit a scanning laser beam having a vertical scanning plane which coincides with beams 106 as depicted and described above.

The invention claimed is:

1. A head for a practise putter, comprising:

a front face with a ball-strike area; and a pair of laser beam emitters located within the head and each emitting a laser beam at a respective side of the ball-strike area, wherein each laser beam emitter comprises:

a body having a beam-emission opening and an elliptical recess behind the opening:

an elliptical enclosure received within the recess and having a laser light source therein:

a locking mechanism engaged upon the body to secure the elliptical enclosure firmly against the elliptical recess in selected angular alignment; and beam emission angle adjustment means for adjusting the angle at which the laser beam is emitted therefrom;

wherein the laser beams converge with one another to a point several yards directly forward of the ball-strike area.

2. The head as claimed in claim 1, wherein the body includes an internal thread and the locking mechanism comprises a locator having an external thread engaging the internal thread, and a collar which bears against the elliptical enclosure upon the tightening of the collar within the body upon rotation.

3. The head as claimed in claim 2, further comprising a sleeve extending rearward of the elliptical enclosure within the body and providing gripping means, by which the elliptical enclosure can be angularly repositioned against frictional engagement between the elliptical enclosure, the collar and the elliptical recess.

4. The head as claimed in claim 3, further comprising a nut threaded upon the sleeve.

* * * * *